United States Patent [19]

Weihrauch

[11] Patent Number: 4,936,633

[45] Date of Patent: Jun. 26, 1990

[54] PROCESS FOR THE PRODUCTION OF BRISTLE ARTICLES AND BRISTLE ARTICLES PRODUCED BY THE SAME

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 207,045

[22] PCT Filed: Nov. 11, 1986

[86] PCT No.: PCT/EP86/00651

§ 371 Date: Apr. 14, 1988

§ 102(e) Date: Apr. 14, 1988

[87] PCT Pub. No.: WO88/03376

PCT Pub. Date: May 19, 1988

[51] Int. Cl.[5] ..... A46D 1/00

[52] U.S. Cl. ..... 300/21

[58] Field of Search ..... 300/21, 2–11; 264/243

[56] References Cited

U.S. PATENT DOCUMENTS 3,053,575 9/1962 Zeilstra ..... 300/21
3,471,202 10/1969 Lewis, Jr. .
3,836,199 9/1974 Blankschein ..... 300/21

FOREIGN PATENT DOCUMENTS 149996 3/1985 European Pat. Off. .
618031 8/1935 Fed. Rep. of Germany .
1049823 3/1959 Fed. Rep. of Germany .
2539417 3/1976 Fed. Rep. of Germany ..... 300/21
2849510 4/1980 Fed. Rep. of Germany .
3501098 7/1986 Fed. Rep. of Germany ..... 300/21
527237 10/1940 United Kingdom .
588576 5/1947 United Kingdom .
2016917A 3/1979 United Kingdom .

*Primary Examiner*—Mark Rosenbaum
*Attorney, Agent, or Firm*—Antonelli, Terry, Stout & Kraus

[57] ABSTRACT

Bristle articles with a bristle carrier having on opposite sides at least one hole for receiving individual of bundle-wise-combined plastic bristles for forming a bristle system on the opposite sides, is produced in that the holes are made in the bristle carrier in such a way that they pass into one another, that the bristles supplied from both sides to the bristle carrier are melted at the ends thereof facing the bristle carrier and are introduced into the facing holes until engagement with the melt within the holes.

18 Claims, 5 Drawing Sheets

Figure 1:
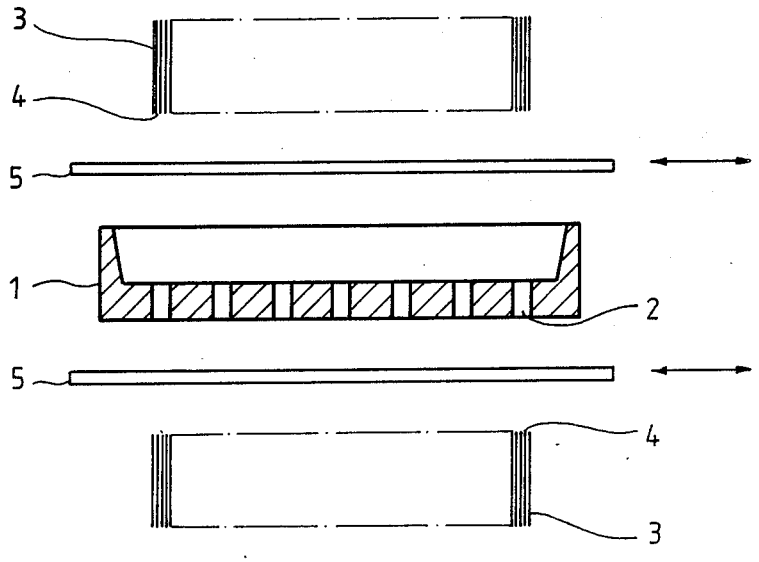

PROCESS FOR THE PRODUCTION OF BRISTLE ARTICLES AND BRISTLE ARTICLES PRODUCED BY THE SAME

The invention relates to a process for the production of bristle articles with a bristle carrier having on opposite sides at least one hole for receiving individual or bundlewise-combined plastic bristles for forming a bristle system on the opposite sides, as well as to bristle articles produced by this process.

Typical examples of bristle articles of the aforementioned type are hand washing brushes or toothbrushes with bristles on both sides, belts, bands or disks for industrial purposes with bristles on both sides, particularly for brushing machines, or mats provided on both sides with bristles, e.g. door mats. Such bristle articles have hitherto been produced in that the case of rigid bristle carriers, whereof both sides have blind holes, usually in reciprocally displaced form and in said holes are introduced the bristles, said bristles then being anchored in the holes. In the case of thin, flexible bristle carriers use is made of a perforated or fabric-like structure and bristles are threaded through the open structure and mechanically fixed to the bristle carrier. The processes are complicated and expensive from the manufacturing standpoint.

As a result of the increasing use of plastic bristles and bristle carriers made from plastics efforts have been made for many years in the case of bristle articles with bristles on one side to interconnect the bristle carrier and bristles by welding. The ends are pressed flush on to the also melted surface of the bristle carrier. The joint is formed following the solidification of the melt.

Problems occur with regards to the choice of plastics in the case of butt welding. In a manner satisfactory for continuous loading, it is only successful when the same materials are used for the bristles and bristle carrier. However, due to the fact that they are loaded, the bristles are made from relatively high quality plastics, so that the same high quality plastics must be used for the bristle carriers, which would not in fact be necessary from the manufacturing standpoint. Therefore the product is made unnecessarily expensive.

Unequal material pairs can be used if the bristles are inserted in blind holes and the latter have undercuts, behind which the melt can flow in order to obtain a completely satisfactory anchoring. However, the production of such undercuts in blind holes is only possible through the use of expensive tools.

For the production of a circular or cylindrical bristle article, it is also known to shape the planar, open structure with the edges and accompanied by the overlap thereof to form a ring and the melted end is forced by bristle bundles through the overlap zone. Following solidification, not only are the bristles anchord, but the ring is also closed.

The aforementioned prior art is described in DE-OS 23 35 468, the latter publication constituting an example for the entire field of the welded or melting connection of bristles and bristle carriers.

The problem of the present invention is to provide a process for the production of bristle articles with bristles on both sides, as well as bristle articles of this type, which allows a simple and inexpensive manufacture and a reliable anchoring of the bristles in the bristle carrier, whilst allowing a random material choice for the bristle carrier.

According to the invention this problem is solved in that the holes are formed in the bristle carrier in such a way that they pass into one another, that the bristles supplied from either side to the bristle carrier are melted at their ends facing said bristle carrier and are introduced into the opposite holes until there is engagement with the melt within the holes.

Unlike in existing technology, in which the bristles or bristle bundles are in each case only connected to the bristle carrier, according to the present invention the bristles on one side of the bristle carrier directly engage with the bristles on the other side, so that the melted ends are interconnected in the case of weldable plastics, or in the case of non-weldable plastics press against the wall of the hole and consequently force closure is obtained. It is readily apparent that when using the inventive process the bristle carrier, which does not have to participate in the melted connection, but can do if necessary, can be made from a random material, e.g. plastic, wood, metal or the like, without this having any unfavourable influence on the connection of the bristles to one another and to the bristle carrier.

In a preferred realization of the process, it is proposed that on the bristle carrier in the vicinity of the holes are provided projections and/or undercuts and/or roughnesses for anchoring the bristles in the melted area, e.g. can be produced at the time of its manufacture or subsequently by thermal shaping. The provision of projections, undercuts or merely roughnesses on the through holes of the bristle carrier ensures an improvement in the anchoring of the bristles, said measures being effective against extraction forces in both directions. Such undercuts or projections can be made both when the holes are produced mechanically and when they are produced thermally, as well as when the bristle carrier and holes are produced by moulding, e.g. injection moulding and no problems are encountered, because each projection projecting into the internal diameter of the holes forms on both sides an undercut for the in each case remote bristles, so that in fact only projections or roughnesses are necessary for achieving an improved extraction-resistant anchoring. In the case of thin bristle carriers and/or deep melting of the bristle ends, the melt remains on the outside of the bristle carrier, accompanied by the formation of a supporting bead.

A bristle article produced according to the aforementioned process with a bristle carrier and plastic bristles arranged on opposite sides in holes of the bristle carrier is inventively characterized in that the holes arranged on opposite sides are interconnected and the bristles introduced from opposite sides into the holes at least up to reciprocal contact are interconnected by melting in the contact area. Preferably the bristle carrier is provided in the vicinity of its holes with projections and/or undercuts and/or roughnesses for anchoring the bristles.

According to a preferred realization the bristle carrier has through holes and projections projecting inwards therein, whereby the projections can be constructed as individual or circularly closed noses, as crossbars or as a constriction of the through hole.

A modified embodiment is characterized in that the holes passing into one another are so arranged on opposite sides of the bristle carrier, that they are reciprocally displaced in the transition area. In this embodiment, through the displacement of one hole with respect to the other, an undercut for the bristles is formed on the in each case facing side. If such displaced holes overlap in the depth, such holes lead to the formation of anchoring feet in the case of non-weldable bristle material.

According to another embodiment the bristle carrier is provided on the opening edge of the holes with a circular protuberance projecting over its surface. As a result of this circular protuberance the melt displaced during the introduction of the melted bristle ends is enclosed. This measure also makes it possible to obtain the bristle carrier in an extremely thin-walled and optionally flexible form, whilst at the same time obtaining an adequate depth of the holes for the fixing and guidance (lateral support) of the bristles.

If the circular protuberance is provided on the inside with a feed bevel for the introduction of the bristle bundles, the further manufacturing advantage is obtained that the melt feeds which occur on melting the bristle ends can be more easily introduced into the hole. This can be further assisted in that the holes in the bristle carrier have feed bevels passing from their opening edge in the inwards direction.

In the case of inventively produced bristle articles, not only can the bristles and bristle carrier be made from different materials, but the actual bristles can be made from different plastics, because by pressing against the wall of the hole and/or in conjunction with the projections or roughnesses on the through holes, in the melting area they have an adequate anchoring even if the two materials cannot be welded together. It is obviously possible to provide on a single bristle carrier in zonal manner bristles made from different materials, in different configurations and in different densities.

The invention also relates to a process for producing bristle articles with a bristle carrier having at least one through hole for receiving individual or bundlewise-combined plastic bristles for forming a bristle system on only one side of the bristle carrier. Such bristle articles are known in numerous different constructions as hand brushes, machine brushes, etc. Their manufacture takes place in the same way as described hereinbefore relative to bristle articles having bristles on both sides of the bristle carrier. Reference can also be made to the introductory comments concerning the relevant prior art.

A simple and inexpensive manufacture, as well as a reliable anchoring of the plastic bristles in the bristle carrier, accompanied by a random choice of material for the bristle carrier is made inventively possible in that the through hole is provided with at least one projection and/or undercut and that the bristles are melted at the end thereof to be fixed in the bristle carrier and after introducing the bristles into the through hole the melt is shaped in the vicinity of the projection or undercut from the back of the bristle carrier.

The use of a through hole in the otherwise solid bristle carrier firstly makes it possible to make the projections or undercuts in simple manner, e.g., in connection with injection moulding. Here again the bristles are melted at their end to be fixed and are so introduced into the through hole that the melt can be shaped from the back of the bristle carrier in the vicinity of the projection or undercut. This ensures a reliable and extraction-resistant seating of the bristles within the bristle carrier.

According to an embodiment the bristles can be introduced from the back of the bristle carrier into the through hole with their use end first, whilst the other end thereof is melted prior to its introduction into the through hole, followed by complete introduction. At the time or subsequently the melt is shaped on the projection or undercut from the back of the bristle carrier. This process variant has the advantage that the bristles only have to be moved in one direction.

Instead of this it is also possible to introduce the bristles from the coverage side of the bristle carrier into the through hole until they project over the back of the bristle carrier, followed by melting on the projecting end thereof and subsequently drawing or shoving back. During or subsequent to this movement the melt is shaped on the projection or undercut from the back of the bristle carrier.

The invention also relates to bristle articles produced according to the aforementioned process and which comprise a bristle carrier and bristles arranged in a through hole thereof. According to the invention this is characterized in that the through hole has projections or undercuts and that the bristles are fixed by melting the end thereof arranged in the bristle carrier and shaping the melt on the projection or undercut on the bristle carrier.

According to an embodiment the projection or undercut can be formed by noses, tori or the like projecting into the through hole. Instead of this it is also possible to form the undercut by means of a diameter enlargement of the through hole on the back of the bristle carrier.

Further details and advantages of the invention can be gathered from the following description of embodiments and the attached drawings, wherein show:

FIG. 1; A diagrammatic representation of an embodiment of the process in one process stage.

FIGS. 3 to 9; In each case a larger-scale part section of different embodiments of the connection of the bristle bundles to one another and/or to the bristle carrier.

Figure 10:
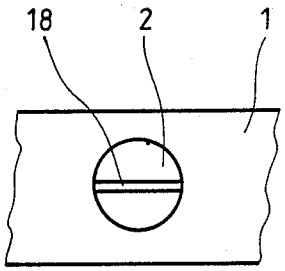
Figure 11:
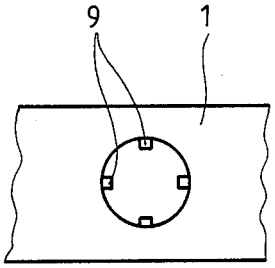

FIGS. 10 and 11; A detail plan view of a bristle carrier with different embodiments for anchoring the bristle bundles.

Figure 12:
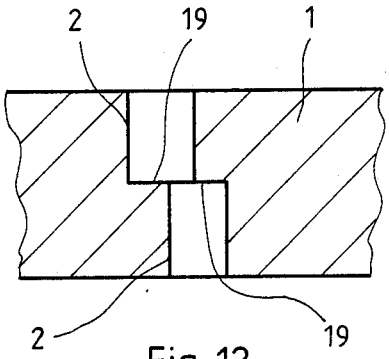
Figure 13:
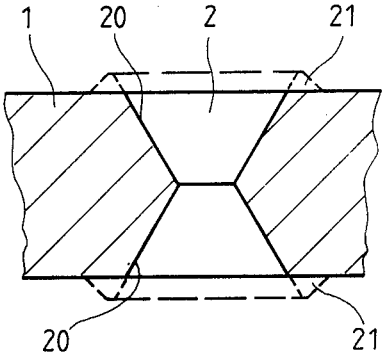

FIGS. 12 and 13; In each case a detail section of a bristle carrier with further embodiments for anchoring the bristle bundles.

Figure 14:
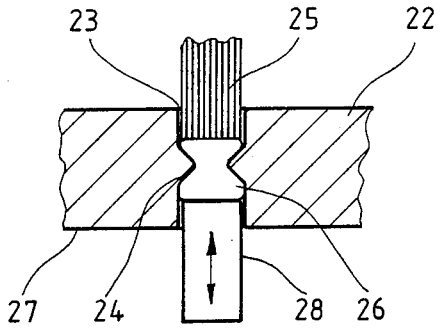
Figure 15:
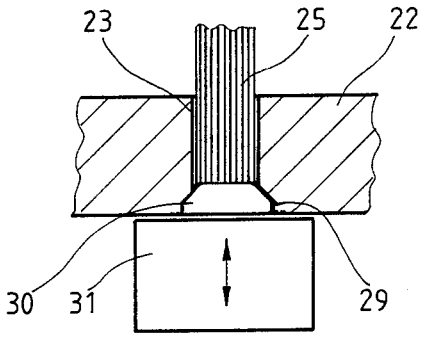
Figure 16:
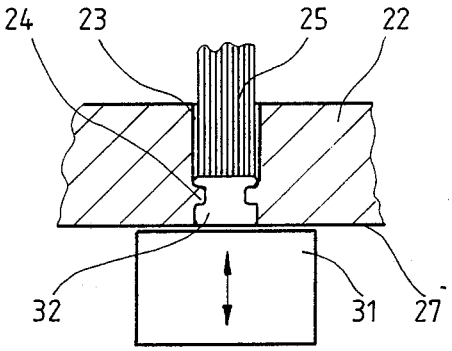

FIGS. 14 to 16; Different embodiments for bristle articles with bristles on only one side.

Figure 17:
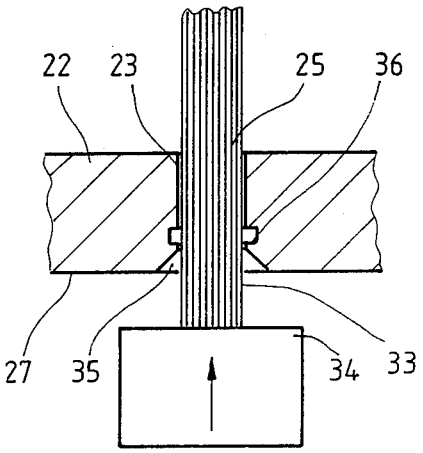
Figure 18:
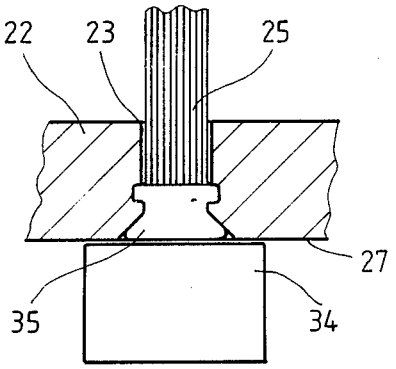

FIGS. 17 and 18; Two process variants in a further embodiment with bristles on one side.

FIG. 1 shows in longitudinal section a bristle carrier (1), such as is e.g. known for hand washing brushes with bristles on both sides. Diverging from the known constructions the bristle carrier (1), which can be made from a random material, has through holes or bores (2), which are produced at the time of its manufacture (injection moulding, foaming or the like) or subsequently by drilling, thermal shaping or the like. A bristle bundle (3) whose end (4) has previously been melted, is introduced from each side into each through hole (2) of bristle carrier (1). The bristle bundles (3) for each side of the bristle carrier (1) are preferably located in a common holder, so that they can be simultaneously introduced into the through holes (2). Melting of the ends (4) of the bristle bundles (3) can take place through contact heat or by contactless heating. FIG. 1 shows in exemplified manner the so-called heating reflector process, in which between the fixed bristle carrier (1) and the bristle bundles (3) located in not shown holders is introduced a heating reflector (5) until the ends (4) have adequately softened. The heating reflectors (5) are then moved out again in accordance with the double arrow and the bristle bundles (3) are inserted in the through holes (2).

Figure 2:
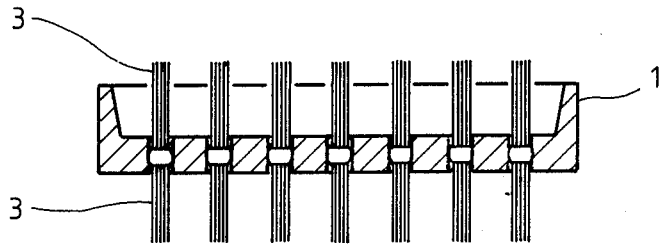

As can be gathered from FIG. 2, the bristle bundles (3) are introduced until they engage with the melted ends and the melt spreads in the through hole. The manner of anchoring the bristle bundles in the bristle carrier (1) can take place in different ways, as is described hereinafter by means of several embodiments.

In the embodiment according to FIG. 1 the through hole (2) in bristle carrier (1) is constructed as a through cylindrical bore, optionally with a certain surface roughness. The bristle bundles (3) introduced from opposite sides into the through hole (2) and whose leading ends are melted, form at the junction point a thickened part (6), which non-positively engages on the wall of through hole (2), so that the bristle bundles (3) are anchored here.

Figure 4:
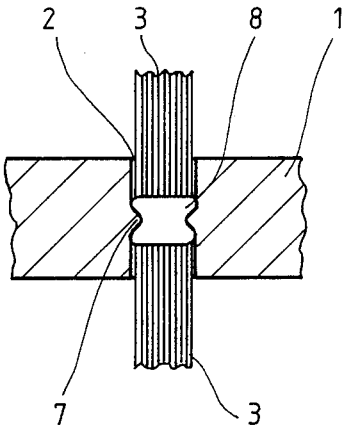

FIG. 4 shows an embodiment in which improved anchoring is achieved in that the through hole (2) roughly at mid-height has nose-like projections (7), which can optionally be combined into a single circular projection. This leads to a constriction in the central region of through hole (2). The converging melt (8) of both bristle bundles (3) flows behind the projection (7), so that the bristle bundles (3) are secured against extraction forces in both directions.

Figure 3:
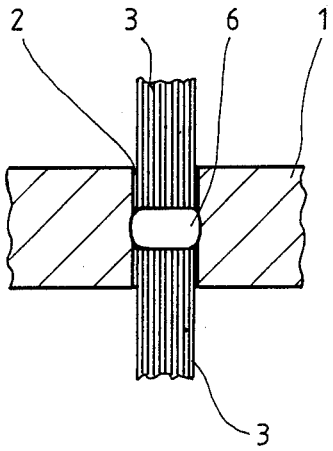
Figure 5:
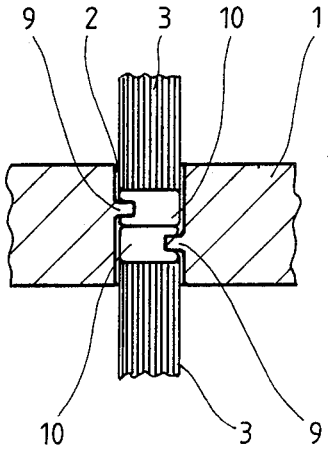

Whereas in the case of the embodiments of FIGS. 3 and 4 the bristle bundles (3) are preferably made from the same interweldable material, FIG. 5 shows an embodiment, which is suitable for nonweldable material. Projections (9) are provided in the central region, but at different heights of the through hole (2). As a result of the displacement of the projections (9), the melt (10) of each bristle bundle can flow behind one or other part of said projections (9), so that each bristle bundle (3) is individually anchored in the bristle carrier. As is e.g. shown in FIG. 11, on the inner circumference of the through hole (2) can be provided several such nose-like projections (9).

Figure 6:
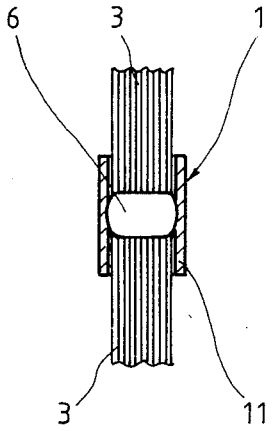

FIG. 6 shows a bristle carrier (1) in the form of a small tube (11), in which are non-positively fixed the bristle bundles (3), once again accompanied by the formation of a thickened part (6), following the convergence of their melted ends.

Figure 7:
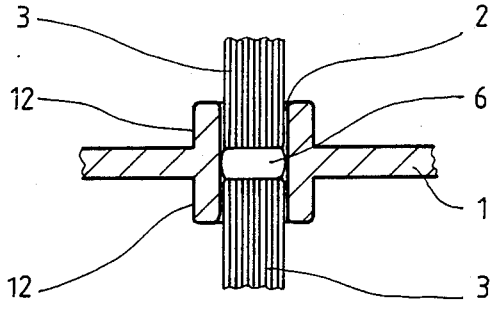

A similar embodiment is shown in FIG. 7 with a very thin bristle carrier (1) with sleeve-like guides (12) projecting on either side and which once against form a through hole (2), in which the bristle bundles (3) are non-positively anchored with a thickened part (6).

Figure 8:
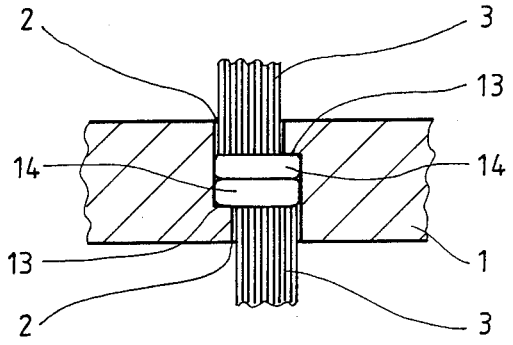
Figure 9:
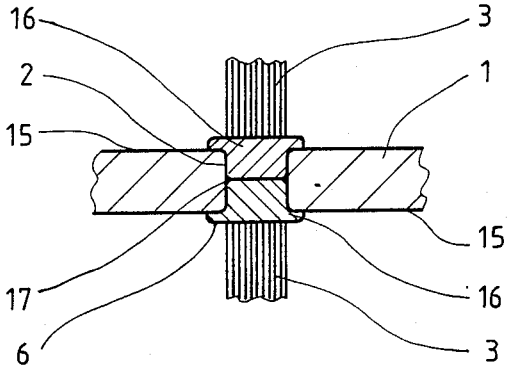

FIG. 8 shows an embodiment, in which the bristle carrier (1) has holes (2) introduced or produced from opposite sides and whose axes are reciprocally displaced, so that in each case an undercut (13) is formed. In the case of abutment of the melted ends of the bristles (3), the melt flows behind the undercuts (13), accompanied by the formation of in each case one thickened part (14), so that once again each bristle bundle is anchored positively. This embodiment is also suitable for bristle materials which cannot be welded together.

In the case of the embodiment according to FIG. 9, there is once again a very thin-walled bristle carrier (1), which can optionally also be pliable and flexible. The ends of the bristle bundles (3) are melted to such an extent that on introduction of said bundles (3) into the through hole (2) and at the time of abutment thereof, a small amount of melt is built up on the outsides (5) of the bristle carrier (1) and leads to the formation of a bead (16) after cooling. In order that the melt coalesces in the central region (17), once again the bristle bundles (3) are secured against extraction forces in both directions.

FIG. 10 is a detail view of a bristle carrier (1) with through hole (2), which contains a transversely directed bar (18), which ensures the necessary anchoring of the bristle bundles should this prove necessary.

In the embodiment according to FIG. 12 the through hole (2) is produced by two reciprocally displaced holes, whose bottoms (19) in each case form an undercut for the bristle bundle introduced from the opposite side. Unlike in FIG. 8, the two holes are not depth-displaced. This embodiment is therefore preferably suitable for bristle materials which can be welded together.

Finally, FIG. 13 shows an embodiment in which the through hole (2) has conical walls (20) forming a type of feed bevel for the bristle bundle melt. Optionally the feed bevel can be extended to a bead (21) projecting over the outsides of the bristle carrier (1).

The representation of the above embodiment shows that any random plastics material can be used for the bristles and that in the case of corresponding mechanical anchoring means different plastics can also be used for both sides of the bristle carrier, e.g. in order to obtain different bristle hardenesses on both sides. It is also possible to use on both sides of the bristle carrier bristle bundles of different diameter or cross-section or with different number of bristles and/or different bristle colours. The bristle carrier can also be made from random materials. It is possible to use almost randomly thin bristle carriers, because a very limited height is sufficient for positive or non-positive anchoring and in particular it is possible in this way to produce belt brushes or the like for industrial purposes. Only certain of the possibilities offered by the invention have been represented hereinbefore.

FIGS. 14 to 18 shows different variants of a process for the production of bristle articles with bristles on only one side. The bristle carrier (22) is once again made from a random material and has one or more through holes (23), provided with projections or undercuts (24).

The bristles (25) are individually or bundlewise inserted in the through holes and melted at their end located in the bristle carrier. The melted end (26) is shaped on the projections or undercuts (24) from the back (27) of the bristle carrier (22). In the embodiment according to FIG. 14 the projection (24) is formed by a type of torus, which engages in the melted end (26), which has hardened after cooling.

The bristle bundle can either be introduced from the back (27) of the bristle carrier and melted during the insertion movement at its trailing end prior to insertion in through hole (23) and the melt can be shaped by means of a die introduced into the through hole (23), or it is possible to feed the bristle bundles through the through hole from the coverage side of the bristle carrier (22), to melt same at the end projecting over the back (27) and to subsequently shape the melted end (26), optionally after again drawing in the bristle bundle (25).

FIG. 15 shows an embodiment in which the undercut is produced by a diameter enlargement (29) of the through hole (23). In this embodiment the melted end (30) is shaped by compressing or pressing on the undercut (29) by means of a die (31).

The embodiment according to FIG. 16 differs from that of FIG. 14 only in that the melted end (32) terminates flush with the back (27) of bristle carrier (22), in which once again use is made of a corresponding die (31) and the bristles (25) with their melted end (32) are introduced into a corresponding position.

In the embodiments according to FIGS. 17 and 18 it is shown that the bristle bundles (25) are introduced into the through hole (23) either from the back of the bristle carrier (22) or from the front until they project over the back. At the projecting end (33), the bristles are melted e.g. by means of an electrically heated die (34) and the melt is shaped on the edge of the through hole (23), it penetrating an annular clearance (36) and simultaneously fills a bevel (35) on the rear end of the through hole (23), so that the melted end (35) which is hardened after cooling terminates flush with the back (27) of bristle carrier (22).

In the same way as die (34), the dies (28 or 31) shown in FIGS. 14 to 16 can be directly used as a melting tool and can at least be heated so that the melt does not solidify too rapidly.

I claim:

1. Process for the production of bristle articles with a bristle carrier having on opposite sides at least one hole for receiving individual or bundlewise-combined plastic bristles for forming a bristle system on the opposite sides, characterized in that the holes are made in the bristle carrier in such a way that they pass into one another, that the bristles supplied from both sides to the bristle carrier are melted at their respective ends facing said bristle carrier and are introduced into the facing holes so that there is engagement of the melted ends with each other within the holes and so that the bristles are anchored in the holes against extraction forces in both directions.

2. Process according to claim 1, characterized in that in the area of the holes on the bristle carrier are formed projections for anchoring the bristles in the melted area.

3. Process according to claim 2, characterized in that the projections are produced in the area of the holes of the bristle carrier at the time of the manufacture thereof.

4. Process according to claim 2, characterized in that in the area of the holes on the bristle carrier are also formed undercuts for anchoring the bristles in the melted area.

5. Process according to claim 4, characterized in that the projections and undercuts are produced in the area of the holes of the bristle carrier at the time of the manufacture thereof.

6. Process according to claim 2, characterized in that in the area of the holes on the bristle carrier are also formed roughnesses for anchoring the bristles in the melted area.

7. Process according to claim 6, characterized in that the projections are produced in the area of the holes of the bristle carrier at the time of the manufacture thereof.

8. Process according to claim 1, characterized in that in the area of the holes on the bristle carrier are formed undercuts for anchoring the bristles in the melted area.

9. Process according to claim 8, characterized in that the undercuts are produced in the area of the holes of the bristle carrier at the time of the manufacture thereof.

10. Process according to claim 9, characterized in that in the area of the holes on the bristle carrier are also formed roughnesses for anchoring the bristles in the melted area.

11. Process according to claim 10, characterized in that the undercuts are produced in the area of the holes of the bristle carrier at the time of the manufacture thereof.

12. Process according to claim 1, characterized in that in the area of the holes on the bristle carrier are formed roughnesses for anchoring the bristles in the melted area.

13. Process according to claim 1, characterized in that in the area of the holes on the bristle carrier are formed projections and undercuts and roughnesses for anchoring the bristles in the melted area.

14. Process according to claim 13, characterized in that the projections and the undercuts are produced in the area of the holes of the bristle carrier at the time of the manufacture.

15. Process according to claim 1, characterized in that the ends of the bristles are melted to such an extend that, following their introduction into the bristle carrier holes, melt remains on the outside of the bristle carrier, accompanied by the formation of a bead.

16. Process for the production of a bristle article having bristles on each of two opposite sides of a bristle carrier, comprising providing a bristle carrier having at least one hole in each of two opposite sides of the bristle carrier for receiving plastic bristles for forming a bristle system with bristles on each of the two opposite sides, the holes in the two opposite sides of the bristle carrier being arranged such that holes on the opposite sides pass in to one another, melting the ends of the plastic bristles and inserting the melted ends of the plastic bristles into the holes from each of the two opposite sides of the carrier so that the melted ends of the bristles engage one another and so that the bristles are anchored in the holes against extraction forces in both directions.

17. Process according to claim 16, wherein the ends of the bristles are melted to such an extent that, following their insertion into the bristle carrier holes, melt remains on the outside of the bristle carrier, accompanied by the formation of a bead.

18. Process according to claim 16, including forming in the area of the holes on the bristle carrier means for anchoring the bristles in the melted area, to accomplish said anchoring the bristles in said holes by way of said means for anchoring during the inserting of the melted ends of the plastic bristles into the holes of the bristle carrier.

* * * * *